US008113741B1

(12) United States Patent
Vidovic et al.

(10) Patent No.: US 8,113,741 B1
(45) Date of Patent: Feb. 14, 2012

(54) BORING MACHINE WITH CONVEYOR SYSTEM FOR CUTTINGS AND METHOD FOR BORING THEREWITH

(75) Inventors: David A. Vidovic, West Salem, OH (US); Michael W. Thomas, Warsaw, OH (US)

(73) Assignee: Astec Industries, Inc., Chattanooga, TN (US)

( * ) Notice: Subject to any disclaimer, the term of this patent is extended or adjusted under 35 U.S.C. 154(b) by 40 days.

(21) Appl. No.: 12/800,670

(22) Filed: May 20, 2010

(51) Int. Cl.
*F16L 1/00* (2006.01)
*E21D 9/10* (2006.01)
*E02D 29/00* (2006.01)

(52) U.S. Cl. ..... 405/184; 405/138; 299/55; 299/56; 175/62

(58) Field of Classification Search ..... 405/184; 299/18, 55, 56, 68; 175/61, 62; 198/550.6, 198/550.1, 545, 657
See application file for complete search history.

(56) References Cited

U.S. PATENT DOCUMENTS

| | | | |
|---|---|---|---|
| 1,371,224 | A | 3/1921 | Campbell |
| 1,403,530 | A | 1/1922 | Whitaker et al. |
| 1,462,997 | A | 7/1923 | Anderson |
| 1,478,466 | A | 12/1923 | Anderson |
| 1,511,957 | A | 10/1924 | Freda |
| RE24,965 | E | 4/1961 | Kirkpatrick |
| 2,988,348 | A | 6/1961 | Robbins |
| 3,061,288 | A | 10/1962 | Robbins |
| 3,139,148 | A | 6/1964 | Robbins |
| 3,237,990 | A | 3/1966 | Robbins |
| 3,290,098 | A | 12/1966 | Scott |
| 3,321,148 | A | 5/1967 | Williamson |
| 3,421,796 | A | 1/1969 | Barrett |
| 3,467,437 | A | 9/1969 | Bolotin |
| 3,517,966 | A | 6/1970 | Montacie |
| 3,672,726 | A | 6/1972 | House |
| 3,812,679 | A | 5/1974 | Ruemmele |
| 3,865,196 | A | 2/1975 | Winberg |
| 4,013,134 | A | 3/1977 | Richmond |
| 4,142,763 | A | 3/1979 | Kumaki |

(Continued)

FOREIGN PATENT DOCUMENTS

JP 08170489 A 7/1996

(Continued)

OTHER PUBLICATIONS

Pipe Jacking, Microtunnelling, Tunnelling & Auger Boring, Trenchless Works; 2009 NoDig Media Services.

(Continued)

*Primary Examiner* — David Bagnell
*Assistant Examiner* — Kyle Armstrong
(74) *Attorney, Agent, or Firm* — Chambliss, Bahner & Stophel, P.C.

(57) ABSTRACT

A boring machine includes a cutter head, an internal casing and an auger that is located within the internal casing. The cutter head and the auger are operationally connected to a rotational mechanism. A rear bulkhead is located at the rear end of the auger, and a rear hopper is located behind the rear bulkhead. The boring machine also includes means for directing material cut by the cutter head into the auger so that rotation of the auger will convey such material rearwardly to the rear hopper. The boring machine includes a transverse conveyor located behind the rear bulkhead in the rear hopper which is adapted to convey material out of the rear hopper in a direction transverse to the longitudinal axis of the auger.

15 Claims, 12 Drawing Sheets

U.S. PATENT DOCUMENTS

| | | | | | |
|---|---|---|---|---|---|
| 4,312,541 | A | | 1/1982 | Spurgeon | |
| 4,394,881 | A | | 7/1983 | Shirley | |
| 4,416,339 | A | | 11/1983 | Baker | |
| 4,456,305 | A | * | 6/1984 | Yoshikawa | 299/33 |
| 4,527,837 | A | | 7/1985 | Snyder | |
| 4,589,502 | A | | 5/1986 | Salter | |
| 4,637,657 | A | | 1/1987 | Snyder | |
| 4,646,853 | A | | 3/1987 | Sugden | |
| 4,874,267 | A | | 10/1989 | Ince | |
| 4,936,709 | A | * | 6/1990 | Kimura | 405/184 |
| 5,046,783 | A | | 9/1991 | Emanuelsson | |
| 5,061,120 | A | | 10/1991 | Akesaka | |
| 5,099,927 | A | | 3/1992 | Gibson | |
| 5,125,768 | A | | 6/1992 | Ilomaki | |
| 5,284,403 | A | | 2/1994 | Ilomaki | |
| 5,295,734 | A | | 3/1994 | Klomaki | |
| 5,361,854 | A | | 11/1994 | Tull | |
| 5,437,500 | A | | 8/1995 | Lehmann | |
| 5,470,132 | A | * | 11/1995 | Cartwright | 299/56 |
| 5,813,482 | A | | 9/1998 | Barbera | |
| 5,863,101 | A | | 1/1999 | Seear | |
| 5,890,771 | A | | 4/1999 | Cass | |
| 6,073,977 | A | * | 6/2000 | Schmidt-Hansen et al. | 285/373 |
| 6,142,577 | A | | 11/2000 | Tayama | |
| 6,206,109 | B1 | | 3/2001 | Monier | |
| 6,431,653 | B1 | | 8/2002 | Kleuters | |
| 6,688,408 | B2 | | 2/2004 | Barbera | |
| 7,048,050 | B2 | | 5/2006 | Vail, III | |
| 7,195,079 | B2 | | 3/2007 | Self | |
| 7,195,083 | B2 | | 3/2007 | Eppink | |
| 7,510,025 | B2 | | 3/2009 | Davies | |
| 2009/0152012 | A1 | | 6/2009 | Salins | |

FOREIGN PATENT DOCUMENTS

| | | |
|---|---|---|
| WO | WO96/06264 | 2/1996 |

OTHER PUBLICATIONS

Akkerman Marketing Brochure for Powered Reaming Head.

* cited by examiner

BORING MACHINE WITH CONVEYOR SYSTEM FOR CUTTINGS AND METHOD FOR BORING THEREWITH

FIELD OF THE INVENTION

The invention relates generally to tunnel boring machines. More particularly, the invention relates to a boring machine which is adapted to install a plurality of differently-sized product casings in a bore. The invention relates to a conveyor system for such a boring machine that is adapted to remove material cut by the machine's cutter head.

BACKGROUND OF THE INVENTION

Subterranean boring machines are used to install a pipe comprised of multiple casing sections or a similar product in the ground without excavating a trench for the pipe. Some boring machines are used to bore a generally horizontal hole and to install a plurality of pipe sections therein between a generally vertical launch shaft or pit and a similarly oriented target shaft or pit. The launch shaft or pit is excavated to a depth to permit the boring machine to be placed in alignment and on grade with the desired underground installation. Boring machines that are commonly placed in such launch pits generally include a track that is located at the bottom of the launch pit and oriented along the desired boring direction, and a carriage that rolls or otherwise travels along the track. The carriage includes a pusher mechanism that is adapted to move the carriage along the track between a start point and a terminal point, and a rotational mechanism that is adapted to rotate a tool carried by the boring machine.

In some conventional boring machines, a pilot hole is first bored along the centerline of the intended product bore. Some such machines use a small pilot head having an inclined face at its leading end. Typically, the pilot system will include a hollow casing, and the pilot head will include an illuminated target on its trailing end. A theodolite mounted at a fixed position in the launch pit apart from the boring machine is aligned so that an operator can view the position of the illuminated target on the pilot head with respect to the cross-hairs of the theodolite. The first section of the pilot casing and the pilot head are pushed into the ground in the boring direction by the pusher mechanism without rotating the pilot head. However, because the inclined face on the pilot head gives rise to a reaction force exerted by the soil through which the head moves, rotation of the head may be required to keep the head on the desired course, as indicated by the position of the target with respect to the cross-hairs of the theodolite. When the carriage reaches the terminal point of the track, the pilot head is disengaged and the carriage is withdrawn to the start point. Multiple sections of pilot casing are added, one by one, to the end of the pilot string and pushed by the pusher mechanism until the pilot head reaches the target pit. After the pilot hole is completed, a boring assembly having an outer diameter that corresponds to the outer diameter of the product casing to be installed is selected. This boring assembly, which comprises a support casing with a cutter head at the leading end and an internal material removal auger or other conveyor located behind the cutter head, is lowered into the launch pit and mounted on the carriage. The boring assembly is attached to the rear end of the pilot casing and aligned with the pilot hole. As the carriage is then pushed or driven along the track following the direction of the pilot hole, the cutter head is operated to bore a hole centered on the pilot hole, and the conveyor is operated to carry the cuttings back towards the launch pit. A plurality of spoil paddles located in a front section of the carriage sweep the cuttings out of the boring machine and into the launch pit through openings provided for that purpose. When the carriage reaches the terminal point of the track, the support casing and internal conveyor are disengaged and the carriage is retracted to the start point. The pilot head is removed from the pilot casing string in the target pit, and an additional section of support casing with an internal conveyor section is mounted to the carriage and attached to the casing and conveyor sections that were disengaged from the carriage. Then the carriage is engaged to drive the support casing further in the boring direction while operating the cutter head and the internal conveyor. Multiple sections of this cutting assembly are added, and the pilot system is removed, piece by piece, from the target pit, until the cutter head reaches the target pit. Then the support casing and conveyor sections are removed, one by one, as product pipe sections of the same outer diameter as the support casing are pushed by the carriage into the bore.

The Bohrtec subsidiary of Herrenknecht sells a machine which may be used for boring a small-diameter tunnel without first forming a pilot bore. The Bohrtec machine employs a boring assembly, carriage and track such as is employed by conventional machines that use a pilot bore, as well as a guidance system that allows an operator to view a target mounted on the back side of the cutter head through the hollow shaft of an auger conveyor. The cutter head of the Bohrtec machine is mounted to a steering module that is selected to match the diameter of the product casing to be installed. A support casing with internal auger conveyor is mounted behind the steering module to which the cutter head is attached, and the head is operated to cut the desired product bore. As the carriage pushes the cutter head in the boring direction while operating the cutter head and the internal auger, cuttings cut by the cutter head are carried by the internal auger through the support casing back to the launch pit. When the carriage reaches the terminal point of the track, the support casing and internal conveyor are disengaged and the carriage is retracted to the start point. An additional section of support casing with an internal conveyor section is mounted to the carriage and attached to the casing and conveyor sections that were disengaged from the carriage. Then the carriage is engaged to drive the steering module and support casing further in the boring direction while operating the cutter head and the internal conveyor. Multiple sections of this cutting assembly are added until the steering module reaches the target pit. Then the support casing and conveyor sections are removed, one by one, as product pipe sections of the same outer diameter are pushed by the carriage into the bore.

Yet another guided tunnel boring machine is described in U.S. Pat. No. 5,813,282. This machine includes a guided steerable head that is attached to a support casing by a plurality of hinge assemblies. The steerable head includes an inner pipe and an outer pipe. The inner pipe is fixed to the outer pipe so as to form an annular space within which the hinge assemblies are mounted. The support casing located immediately behind the steerable head also includes an inner pipe that is fixed with respect to the outer casing so as to form a continuation of the annular space around the inner pipe of the steerable head to accommodate the hinge assemblies. Steering actuators are mounted within the annular space of the steerable head and operatively connected to the steering hinge assemblies. A cutter head is mounted in front of the steerable head, and a conveyor auger is located within the inner pipe of the steerable head and the first casing, which auger is adapted to convey material cut by the cutter head towards the launch pit. Hydraulic and control lines for the steering head extend from the drive carriage along the top of the support casings to a junction box located on top of the first casing.

NOTES ON CONSTRUCTION

The use of the terms "a", "an", "the" and similar terms in describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

The use of any and all examples or exemplary language (e.g., "such as") herein is intended merely to better illuminate the invention and not to place a limitation on the scope of the invention, unless otherwise indicated by the claims. Nothing in the specification should be construed as indicating any non-claimed element as essential to the practice of the invention.

Various terms are specifically defined herein. These terms are to be given their broadest possible construction consistent with such definitions, as follows:

The term "boring direction", when used in describing the operation of a boring machine or the relative position of a component of a boring machine, refers to the direction of advance of the cutter head of the machine as the boring operation is carried out.

The terms "front" and "front end" of the boring machine refer to the end of the machine that leads in the boring direction. When referring to a component of the boring machine, the terms "front" and "front end" refer to that portion of the component that is nearer the front end of the boring machine.

The terms "rear" and "rear end" of the boring machine refer to the end opposite the front end. When referring to a component of the boring machine, the terms "rear" and "rear end" refer to that portion of the component that is nearer the rear end of the boring machine.

The terms "forward" and "in front of", as used herein to describe a relative position or direction on or in connection with a boring machine, refer to a relative position towards the front end of the machine or towards the boring direction.

The terms "rearward", "behind" and "rearwardly", as used herein to describe a relative position or direction on or in connection with a boring machine, refer to a relative position or direction towards the rear end of the machine or opposite the boring direction.

The terms "product casing", "product casing component", "product casing section" and similar terms refer to a section of pipe or other product that is installed or intended to be installed in a bore. The term "product casing" may also refer to a plurality of sections of pipe or other product or product casing components that are joined, or intended to be joined, together. The term "differently-sized product casings" refers to product casings having different inside diameters and/or outside diameters. The terms "a selected one of the product casings", "selected product casings" and similar terms refer to a product casing having an inside diameter that is selected for installation within a particular bore. The term "corresponds" and similar terms, when used to compare a diameter or other dimension of a component of the auger boring machine with a similar dimension of "a selected one of the product casings", refers to the suitability of the component having such dimension for use in installing the "selected one of the product casings".

The terms "internal casing", "internal casing component", "internal casing section" and similar terms refer to a section of the portion of the boring machine that is adapted to include an auger section which is adapted to rotate with respect to the internal casing. The term "internal casing" may also refer to a plurality of sections of internal casing or internal casing components that are joined, or intended to be joined, together.

SUMMARY OF THE INVENTION

The invention comprises a boring machine that is adapted to install a plurality of differently-sized product casings in a bore. The boring machine includes an internal casing which has a diameter less than that of all of the product casings that can be installed by the boring machine. The internal casing also has a longitudinal axis that is aligned with the longitudinal axis of the selected product casing to be installed so that an annular space is formed between the product casing and the internal casing. An auger is located within the internal casing and operatively connected to a rotational mechanism so as to rotate with respect to the internal casing. A rear bulkhead is located at the rear end of the auger, and a rear hopper is located behind the rear bulkhead. A cutter head includes a plurality of cutter blades that are attached to the front end of the auger, either directly or indirectly, and adapted to rotate therewith. A conveyor system for cuttings cut by the cutter head as the product casing is advanced in the boring direction includes the auger, means for directing material cut by the cutter head into the auger, and a transverse conveyor that is located behind the rear bulkhead in the rear hopper. The transverse conveyor carries material out of the rear hopper in a direction transverse to the longitudinal axis of the auger.

In a preferred embodiment of the invention, the boring machine includes an adjustable support assembly that is adapted to be located between the outside surface of the internal casing and the inside surface of the selected product casing for maintaining the coincidence of the longitudinal axis of the internal casing with the longitudinal axis of the selected product casing, without closing off the annular space between the internal casing and the selected product casing.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which:

FIG. 3 also shows a first-sized cutting head and product casing in solid lines, and the outline for a second-sized cutting head and product casing in broken lines.

FIG. 11 illustrates details of a means for directing material cut by a cutter head into the internal casing.

DESCRIPTION OF THE PREFERRED EMBODIMENTS OF THE INVENTION

Figure 1:
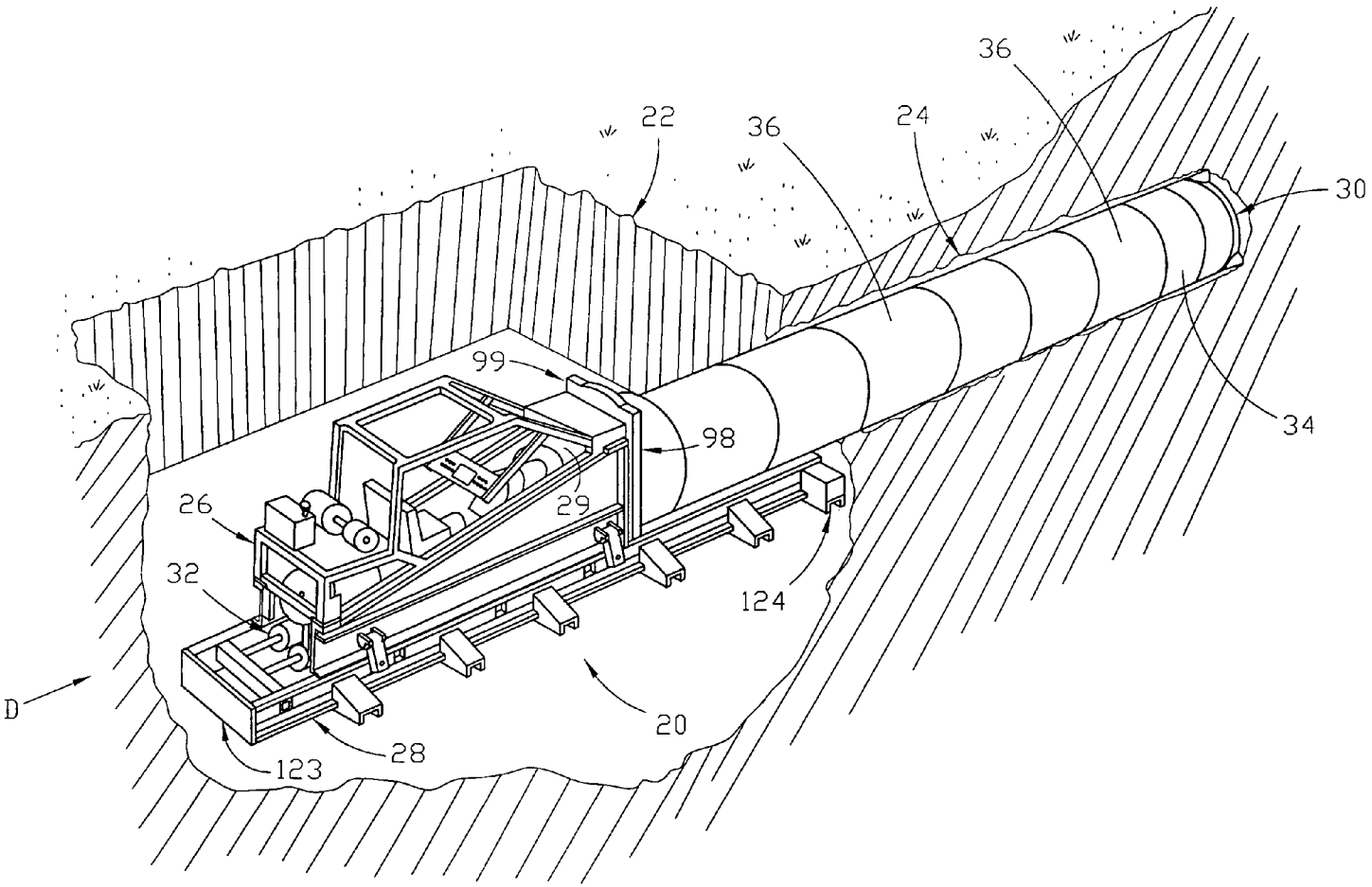
FIG. 1 is a perspective view of a boring machine constructed according to a preferred embodiment of the invention, showing the machine in a launch pit.

Referring now to FIG. 1, boring machine 20, comprising a preferred embodiment of the invention, is located in launch pit 22 and is shown as it would appear in the process of boring tunnel 24. Boring machine 20 includes carriage 26 which is mounted on and adapted to move along track 28 in boring direction D. The carriage includes conventional rotational mechanism 29 for operating a selected one of a plurality of cutter heads, such as cutter head 30, and conventional pusher mechanism 32 for pushing or driving the carriage along the track.

Figure 3:
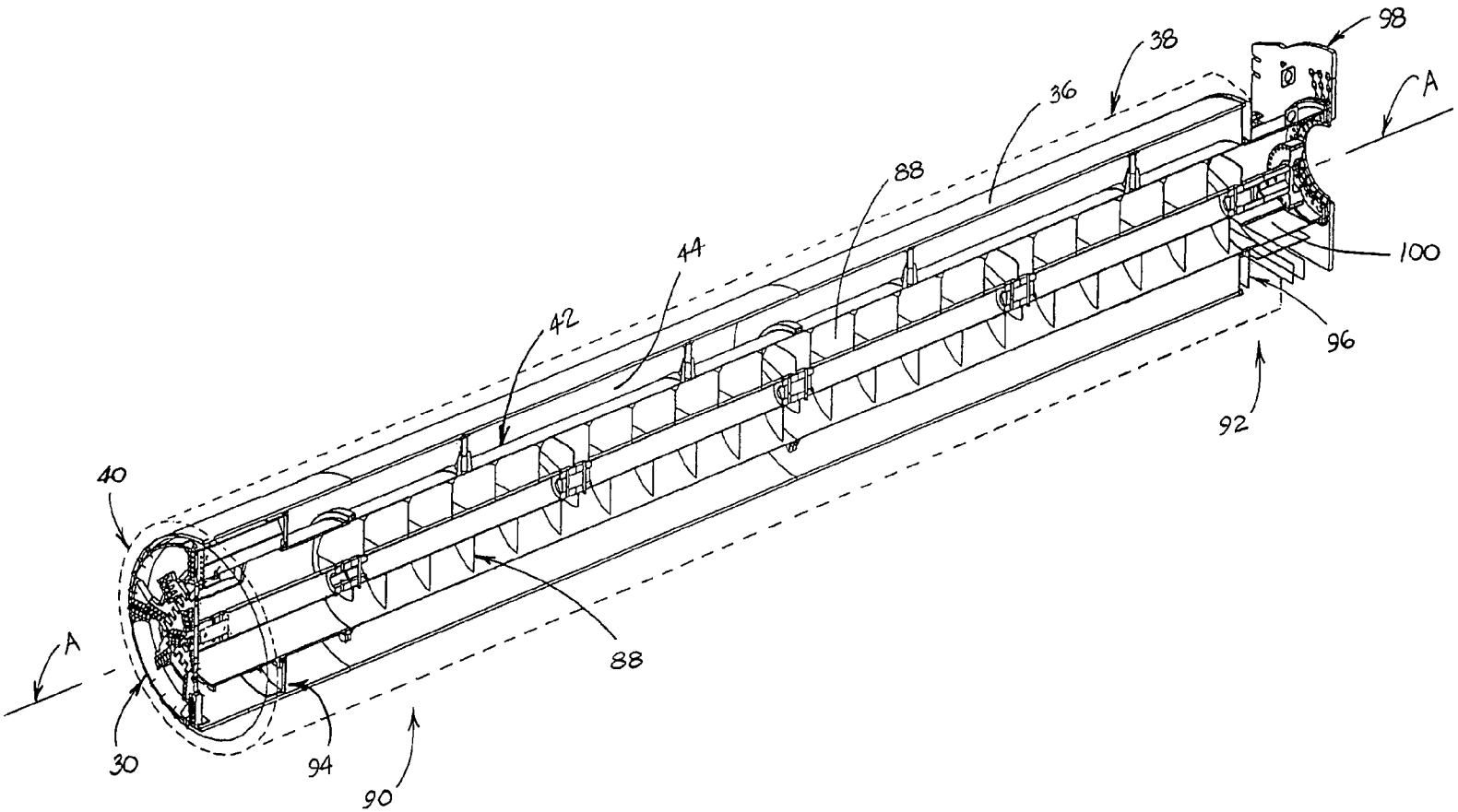
FIG. 3 is a sectional view of a portion of the boring machine of FIG. 2, taken along the line 3-3 of FIG. 2, but modified to show a portion of a cutter head and an intact product casing.

Boring machine 20 also includes a plurality of steering heads, including steering head 34, and is intended for use in installing a plurality of product casings of various sizes, including product casing 36 (shown in solid lines in various drawings) and alternative product casing 38 (shown in dashed lines in FIG. 3). Each product casing of a particular size, such as product casing 36, that is installed in a bore is comprised of a number of product casing components that are joined together, end to end. Each cutter head and steering head is selected to correspond to the diameter of the tunnel to be bored and to the diameter of the selected product casing to be installed. Preferably, the steering head is welded to the front end of the first product casing section, and the cutter head is welded to the front end of the steering head.

FIG. 3 also shows (in broken lines) alternative cutter head 40, along with cutter head 30. Thus, the preferred boring machine includes a plurality of sets of cutter heads and steering heads for use in connection with a plurality of differently-sized product casings. The outside diameter of the cutter head and steering head in each set corresponds to the outside diameter of the selected product casing to be installed. Each of the product casings has a product casing longitudinal axis A (shown in FIG. 3), a product casing outside diameter such as outside diameter $OD_{36}$ of product casing 36 (shown in FIG. 4), a product casing inside diameter such as product casing inside diameter $ID_{36}$ of product casing 36, and a product casing inside surface, such as product casing inside surface $S_{36}$ of product casing 36.

Figure 2:
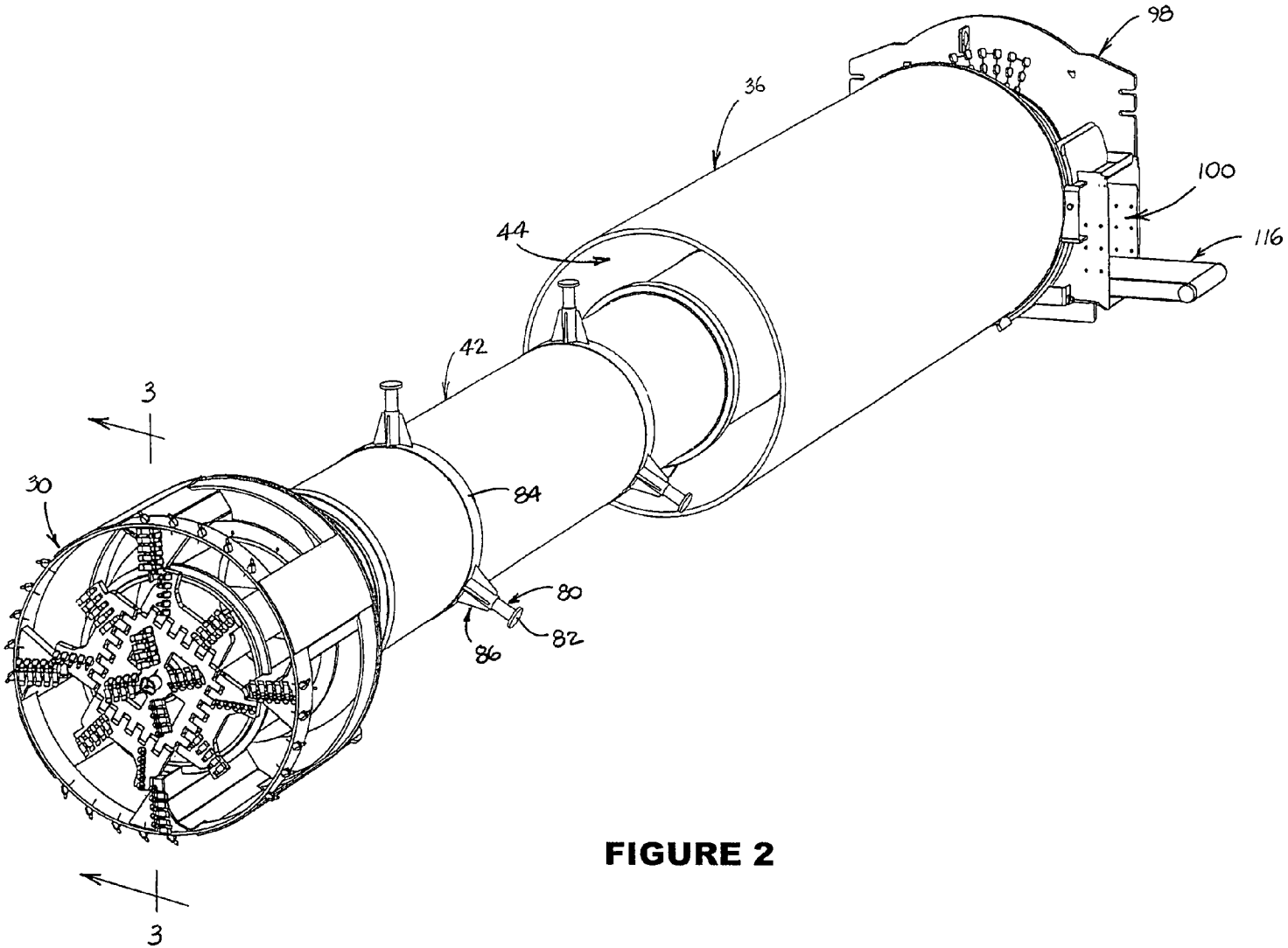
FIG. 2 is a partial perspective view of the boring machine of FIG. 1, showing a cutter head, a portion of a product casing, an internal casing, an adjustable support system and a transverse conveyor.

The boring machine also includes internal casing 42 (not shown in FIG. 1) having an outside diameter $OD_{42}$ which is less than the inside diameter of all of the product casings that can be installed using the machine. Preferably, internal casing outside diameter $OD_{42}$ is no more than about 60% of the product casing inside diameter of the product casing having the smallest product casing inside diameter that can be installed. Internal casing 42 is adapted to be placed within a selected one of the product casings with its internal casing longitudinal axis coincident with longitudinal axis A of the selected product casing, so that, regardless of which product casing size is selected, an annular space, such as space 44 shown in FIGS. 2-4, will be formed between outside surface $S_{42}$ of internal casing 42 and the inner surface of the product casing. Hydraulic lines, cables and wiring for the cutter head and steering head (not shown in the drawings) are placed within this annular space and protected from contact with the tunnel walls and from contact with material cut by the cutter head as boring is carried out. Furthermore, a laser guidance system for the steering assembly (not shown in the drawings) may be operated within the annular space, where it will also be protected.

Figure 4:
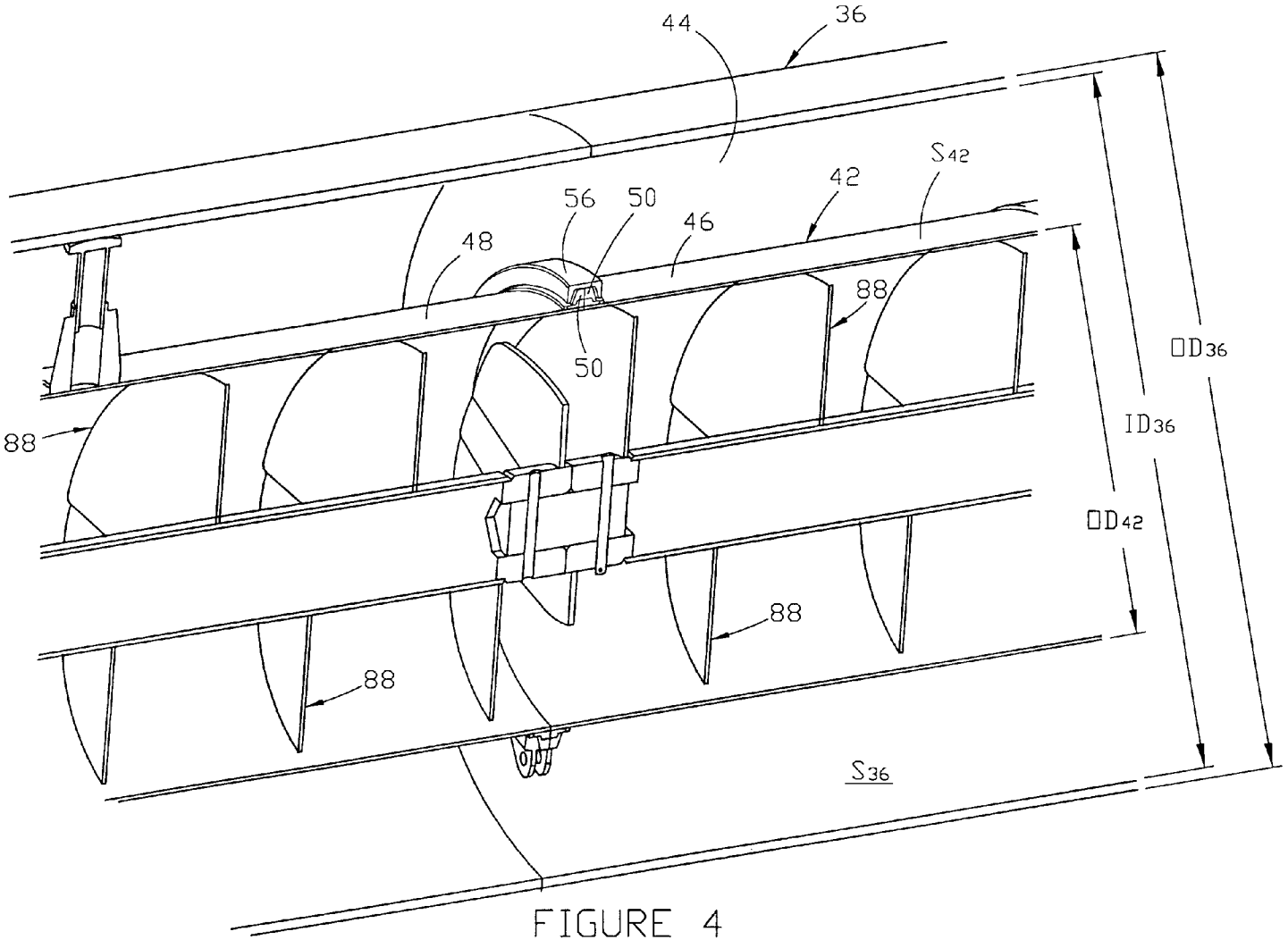
FIG. 4 is a detailed view of a portion of the boring machine of FIG. 3, showing an internal casing joint between a pair of internal casing components of a preferred embodiment of the invention.
Figure 6:
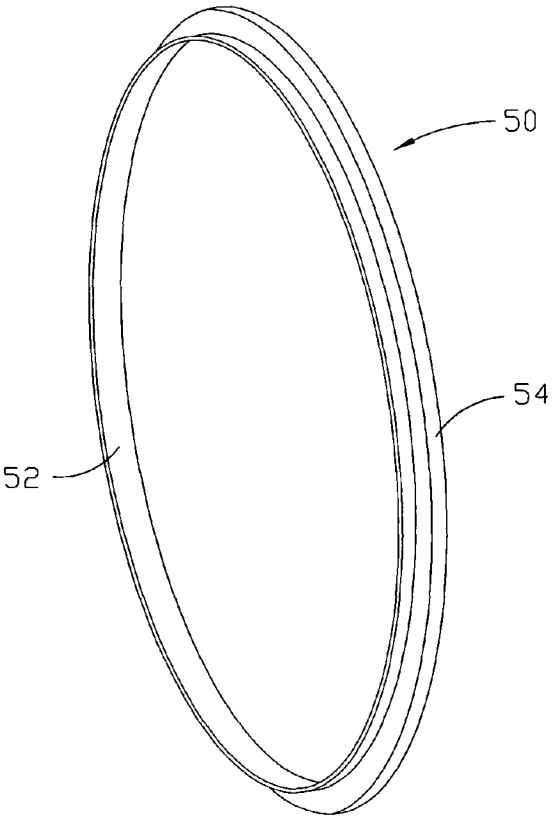
FIG. 6 is a perspective view of the end flange of FIG. 5.
Figure 5:
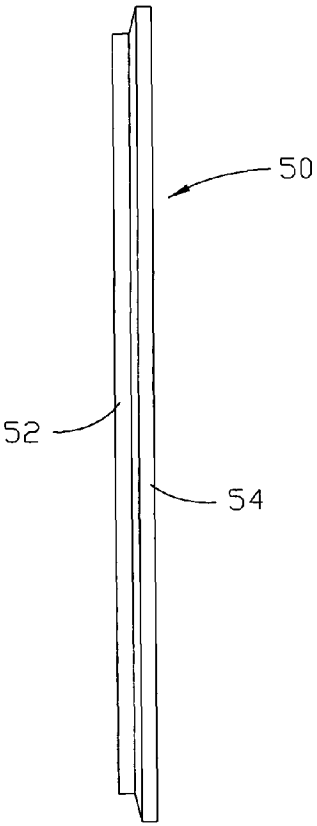
FIG. 5 is a side view of an end flange of a preferred embodiment of the invention.
Figure 7:
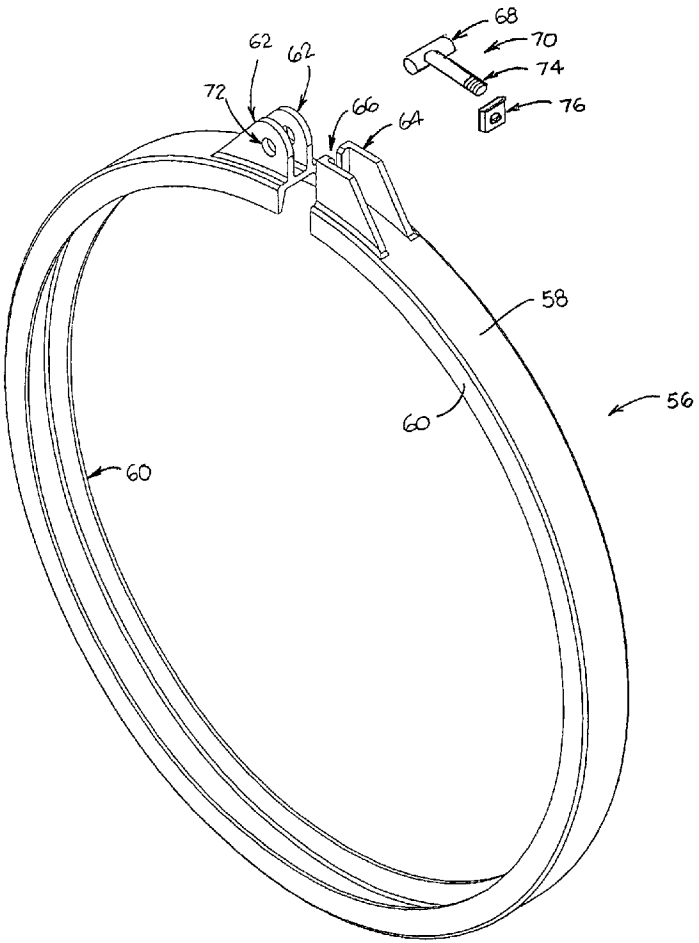
FIG. 7 is a perspective view of a clamp of a preferred embodiment of the invention.
Figure 8:
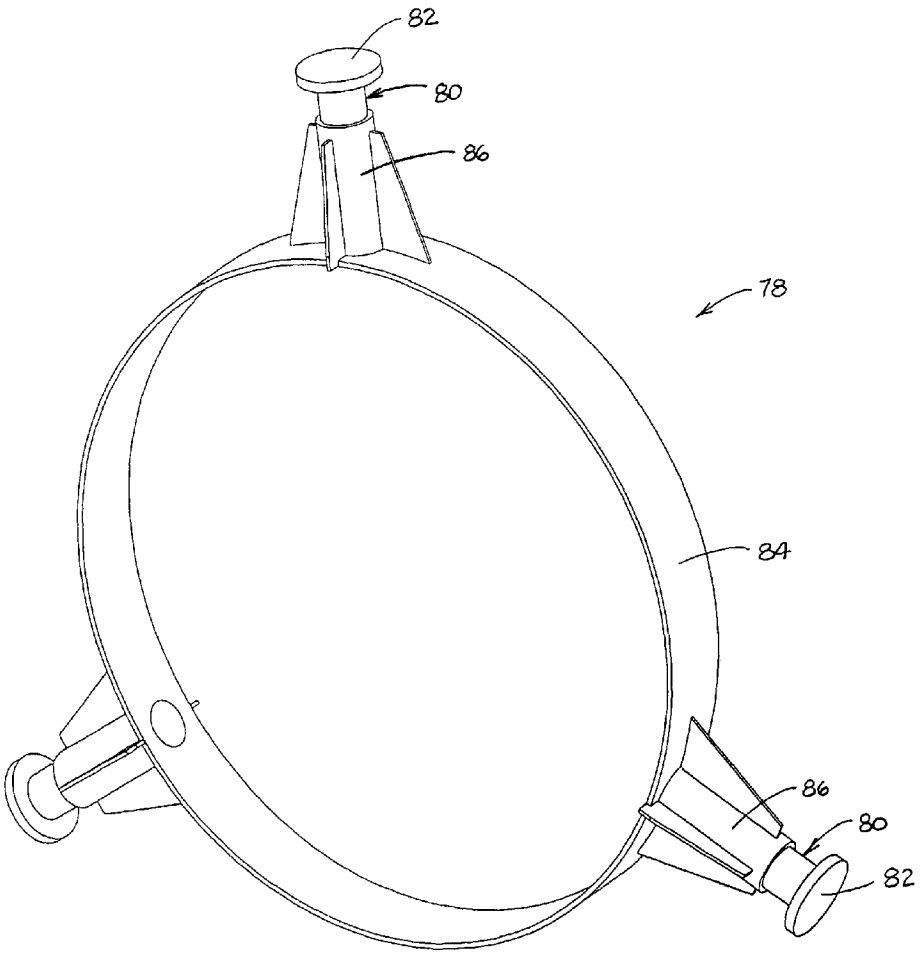
FIG. 8 is a perspective view of an adjustable support assembly of a preferred embodiment of the invention.

Preferably, the internal casing comprises a plurality of internal casing components that are joined together end to end at a plurality of internal casing joints. As best shown in FIG. 4, internal casing 42 comprises a plurality of internal casing components, including internal casing components 46 and 48. Components 46 and 48 are joined together at an internal casing joint comprising end flanges 50 mounted to adjacent ends of adjacent internal casing components 46 and 48. As best shown in FIGS. 4-7, each end flange includes band portion 52 that is welded or otherwise secured to the outside surface of internal casing 42, and upstanding rim 54 that is adapted to be engaged by clamp 56. More particularly, each clamp 56 is adapted to encircle and engage the end flanges of adjacent internal casing components. As shown in FIG. 7, preferred clamp 56 is a band 58 having a pair of flange engagement sides 60 and a pair of ends that can be drawn together. One end includes a pair of spaced eyes 62 and the other includes engagement bracket 64 with engagement slot 66. T-shaped head 68 of bolt 70 is adapted to be received in holes 72 in spaced eyes 62, and threaded end 74 of bolt 70 extends into engagement slot 66. Nut 76 threads onto threaded end 74 of the bolt and is retained within engagement bracket 64.

The preferred boring machine also includes an adjustable support assembly that is adapted to be located between outside surface $S_{42}$ of internal casing 42 and the inside surface of each of the product casings for maintaining the coincidence of the internal casing longitudinal axis with the product casing longitudinal axis, without closing off the annular space between the internal casing and the selected product casing. Preferred adjustable support assembly 78 comprises a plurality of internal casing support legs 80 that are spaced around the periphery of the internal casing and along its length. Each support leg 80 includes a bearing pad 82 that is adapted to bear against the inside surface of the selected product casing, such as against product casing inside surface $S_{36}$ of product casing 36. Adjustable support assembly 78 also includes internal support band 84 that is disposed around the periphery of the internal casing and welded or otherwise affixed thereto. Adjustable support assembly 78 also includes a plurality of leg supports 86, each of which is adapted to cooperate with an internal casing support leg 80 in the preferred adjustable support assembly. Preferably, each of internal casing support legs 80 is provided with external threads and each cooperating leg support 86 is provided with corresponding internal threads, so that the length of the portion of each support leg 80 that extends from its corresponding leg support 86 can be adjusted, by threading the support leg into or out of the leg support, depending on the inside diameter of the product casing, such as product casing inside diameter $ID_{36}$ of product casing 36.

The preferred boring machine also includes a material conveyor system for removing material cut by the cutter head. This system includes auger 88, which is located within the internal casing and has front end 90 and rear end 92 (shown in FIG. 3). Conventional rotational mechanism 29 is operationally attached to auger 88, and the auger is adapted to rotate with respect to internal casing 42, so that operation of the rotational mechanism will cause the auger to convey material in the internal casing towards rear end 92 of the auger.

Figure 9:
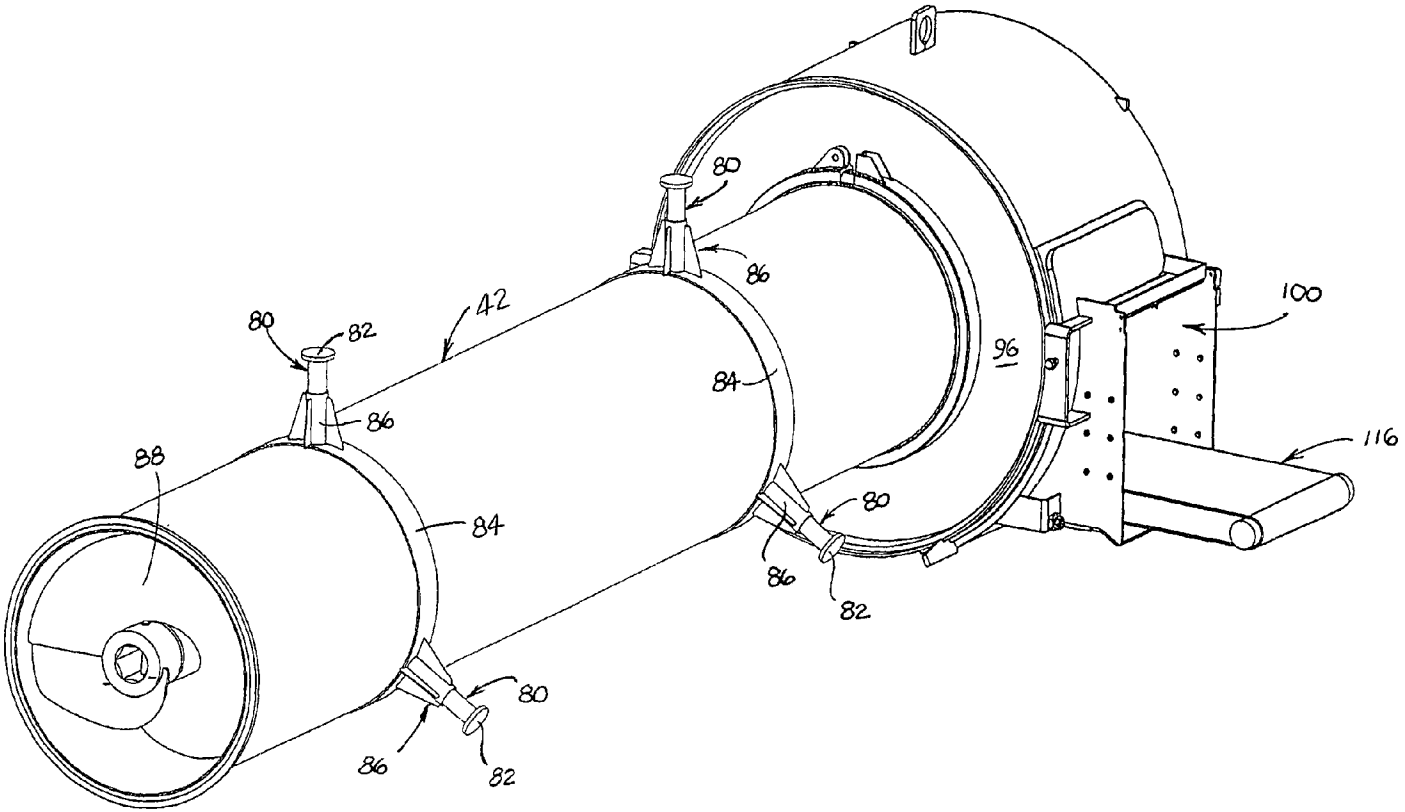
FIG. 9 is a partial perspective view of a portion of the boring machine of FIG. 2, with the cutter head and product casing removed.
Figure 13:
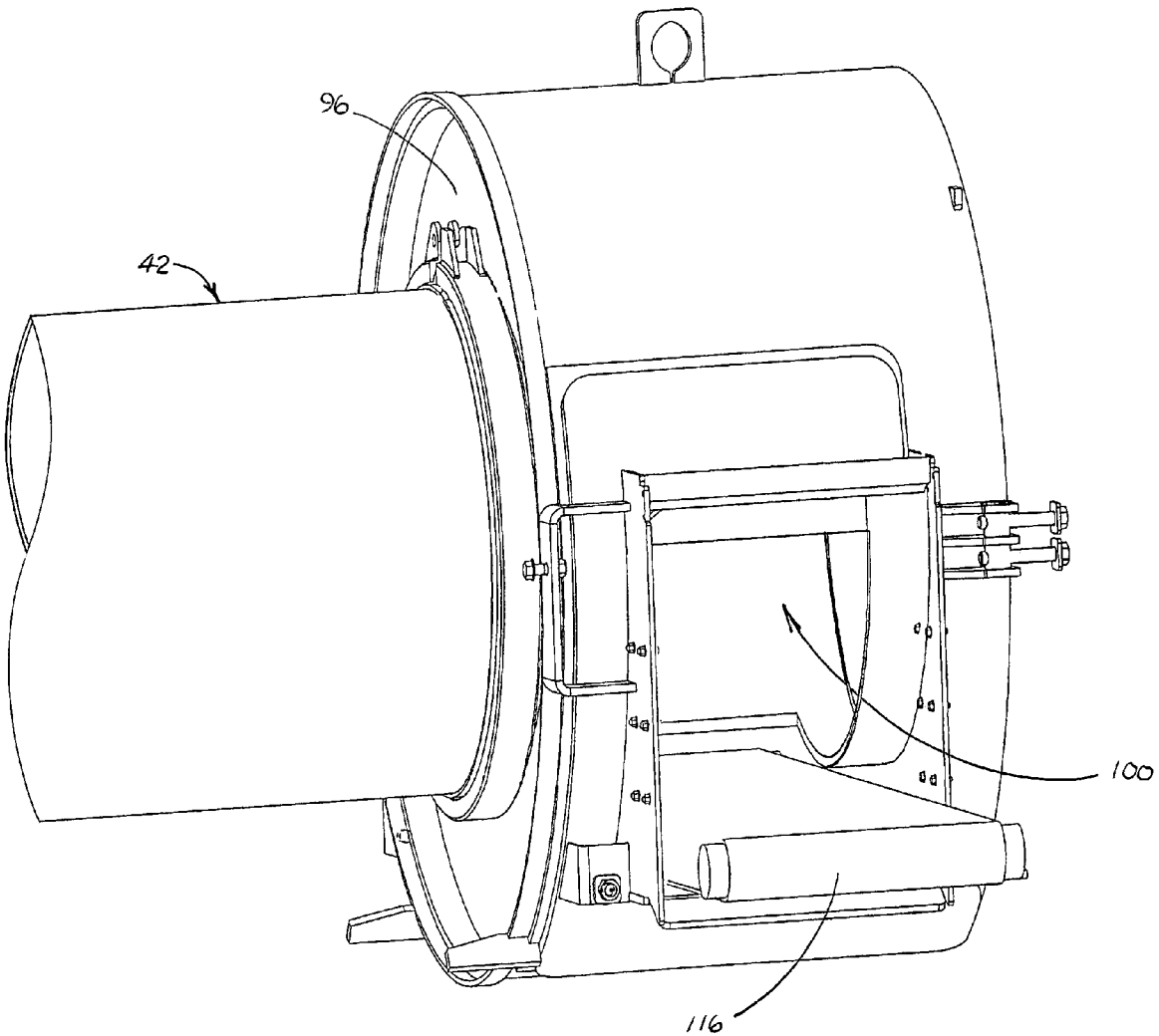
FIG. 13 is a partial perspective view of a rear hopper and transverse conveyor which are a part of a preferred embodiment of the invention.

The preferred boring machine includes a plurality of front bulkheads, such as front bulkhead 94 (shown in FIGS. 3 and 11), each of which is adapted to be located around the internal casing behind the selected cutter head and in front of the adjacent steering head. One function of the front bulkhead is to insure that material cut by the cutter head does not get into annular space 44 between outside surface $S_{42}$ of internal casing 42 and the inner surface of the selected product casing. The preferred boring machine also includes a plurality of rear bulkheads, such as rear bulkhead 96 (shown in FIGS. 3, 9 and 13), each of which is adapted to be located between the inside surface of a selected one of the product casings and outside surface $S_{42}$ of internal casing 42 near rear end 92 of auger 88. Rear bulkhead 96 is also located in front of carriage bulkhead 98 (shown in FIGS. 1-3), which is located at front end 99 of carriage 26. Rear hopper 100 is located between the rear bulkhead and the carriage bulkhead.

Figure 10:
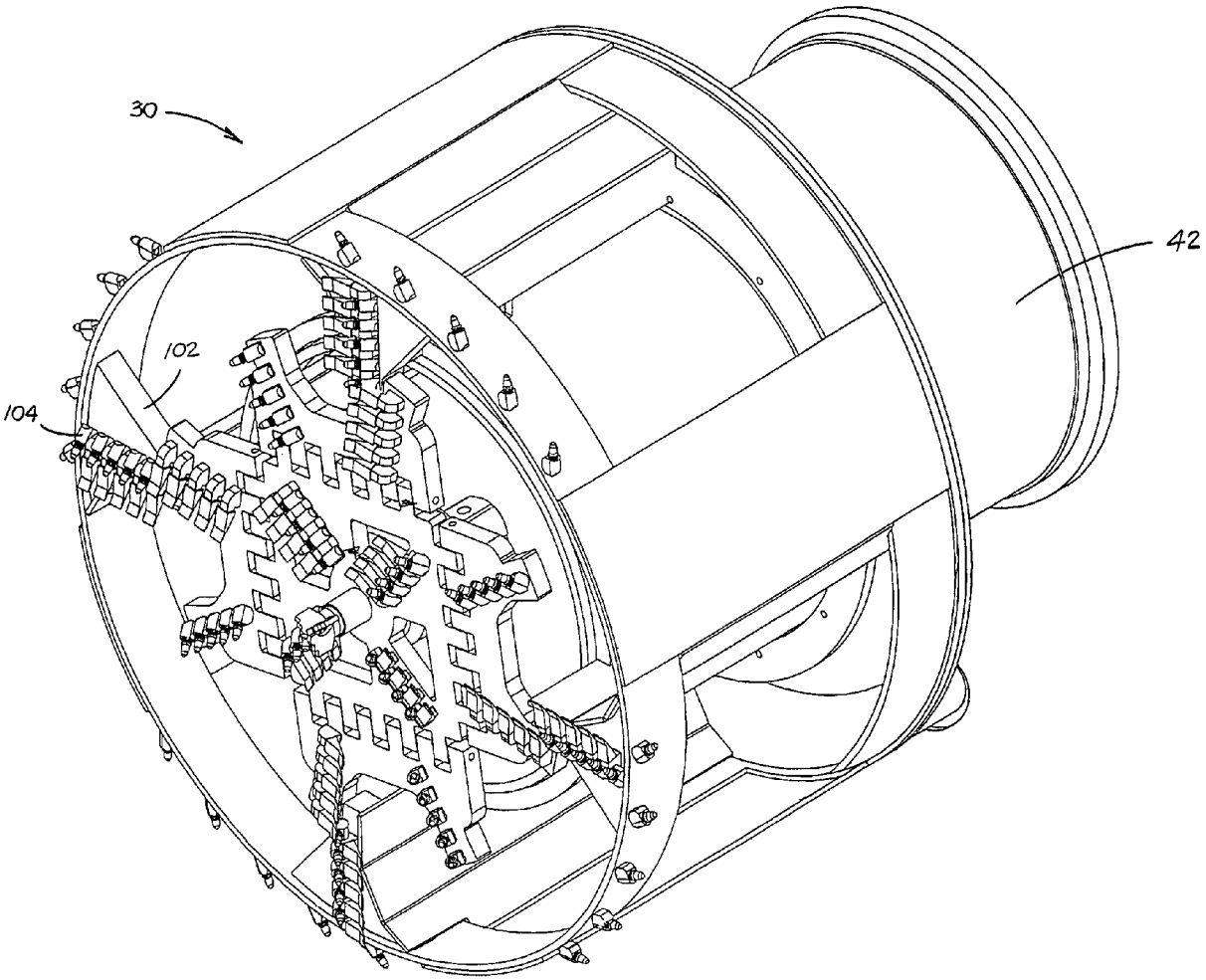
FIG. 10 is a perspective view of a portion of the boring machine of FIG. 2, showing a cutter head and a portion of an internal casing.
Figure 11:
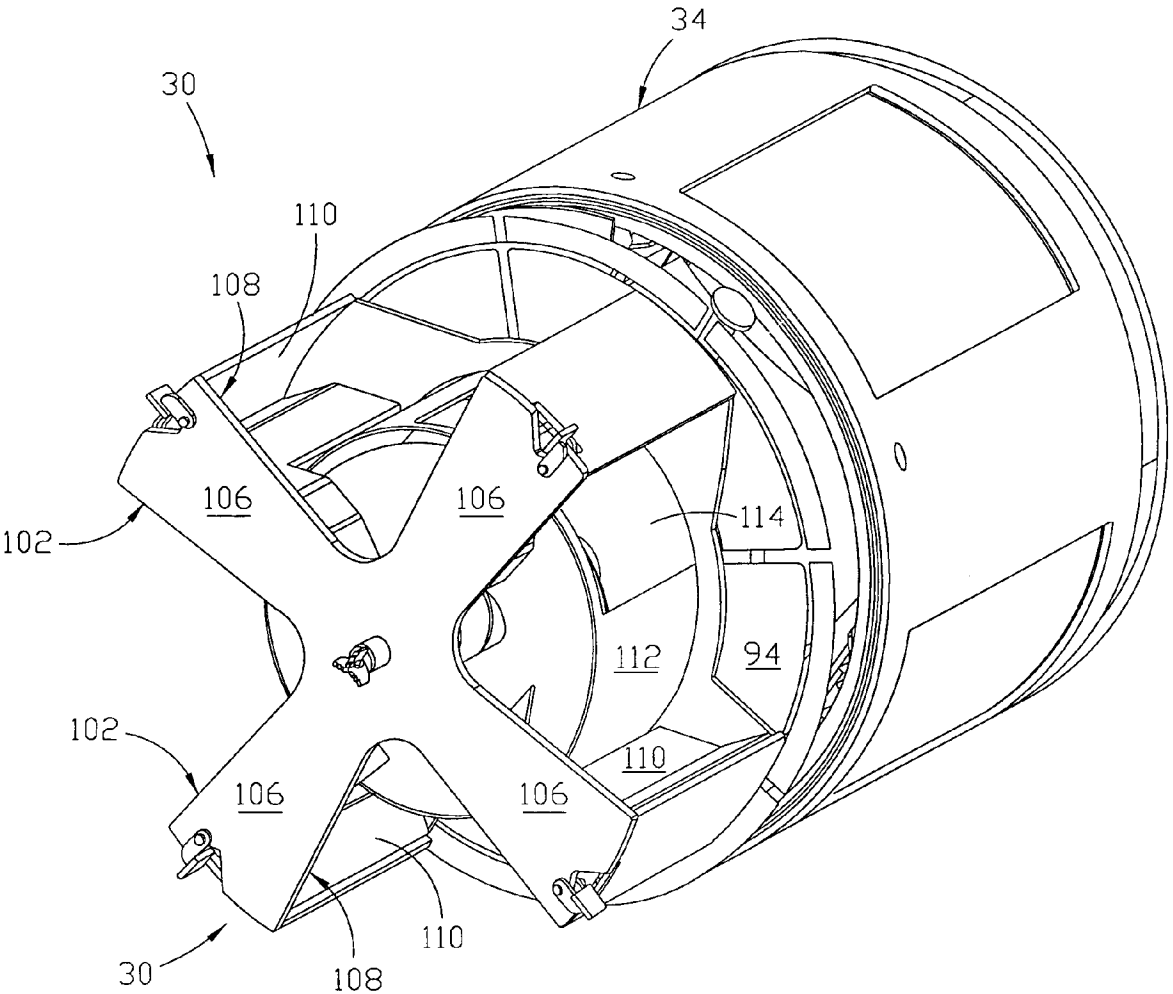
FIG. 11 is a perspective view of a portion of the boring machine of FIG. 2, which is similar in some respects to FIG. 10.

As best shown in FIGS. 10 and 11, the preferred cutter head 30 for boring machine 20 includes a plurality of cutter blades 102 that are connected, either directly or through a linkage mechanism, to the auger. Each of cutter blades 102 has a plurality of cutter teeth 104 (not shown in FIG. 11) mounted thereon, a front side 106 and a rear side 108. The preferred material conveyor system also includes means for directing material cut by the cutter blades of the selected cutter head into the internal casing (or into the auger) so that rotation of the auger will convey such material towards the rear end of the auger within the internal casing. In the embodiment of the invention illustrated by the drawings, the means for directing material cut by the cutter blades into the internal casing comprises a plurality of collecting buckets 110 (best shown in FIG. 11), each of which is mounted on the rear side of a cutter blade. These collecting buckets sweep material cut by the cutter blades into hopper 112 through hopper opening 114 as the cutter blades rotate. Hopper 112 is an extension of internal casing 42 and includes front end 90 of auger 88.

Figure 12:
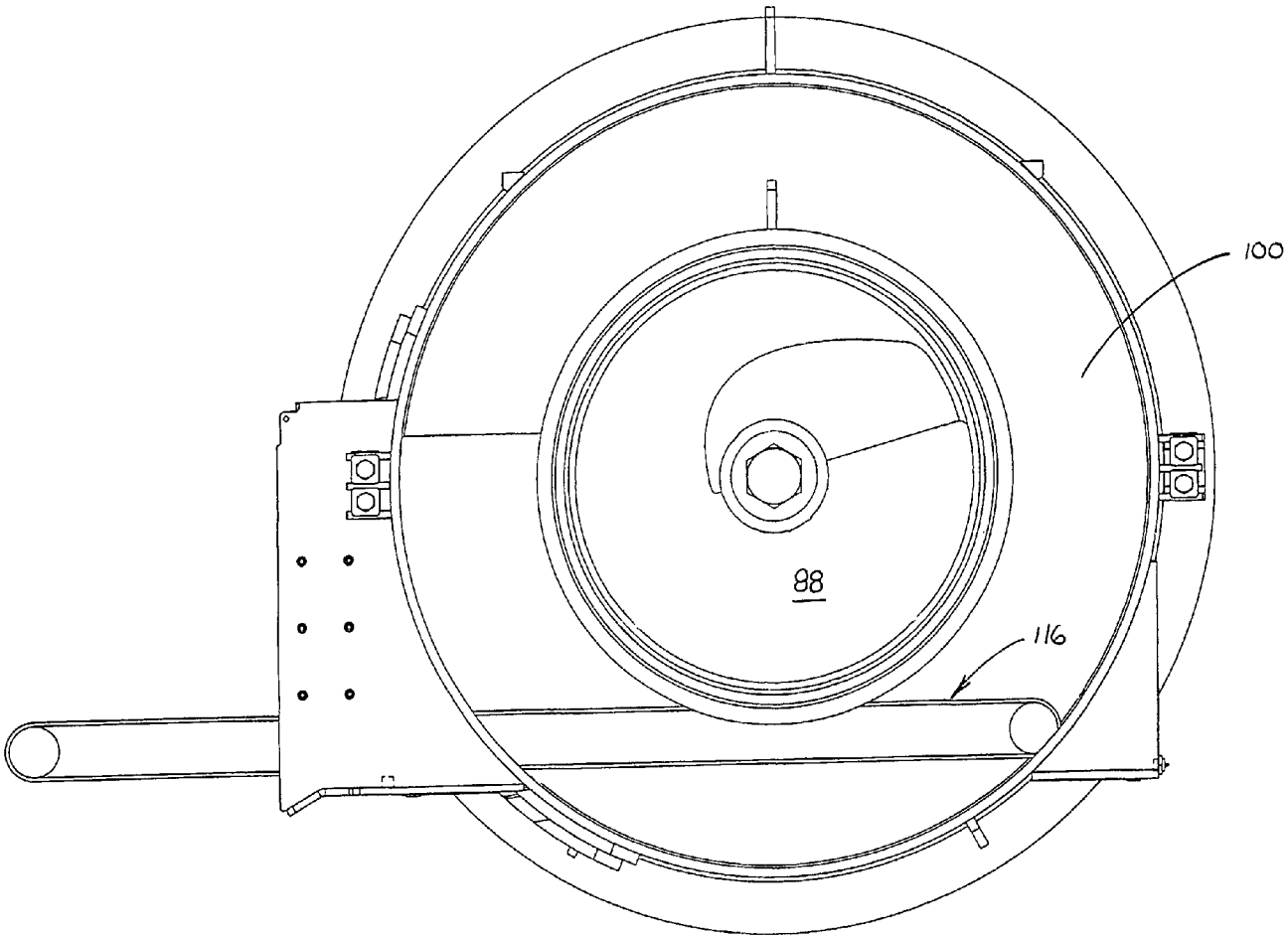
FIG. 12 is a front view of the embodiment of FIG. 9, with the preferred adjustable support assemblies and the rear bulkhead removed.

Once material cut by the cutter head is swept into auger 88, it is carried by the rotation of the auger towards the rear end of the auger and into rear hopper 100. Located at the lower end of rear hopper 100 is transverse conveyor 116, which is adapted to convey material out of the rear hopper in a direction transverse to the auger longitudinal axis, as best shown in FIG. 12.

To begin the boring of a tunnel in a desired boring direction and the simultaneous installation of a selected product casing, a launch pit and a target pit are excavated. Track 28 is placed in the launch pit and oriented in the desired boring direction D towards the target pit. Carriage 26 is then mounted on the track in the launch pit. A product casing is selected from the differently-sized product casings that may be installed using the boring machine, and a cutter head is selected so as to have a cutter head diameter which corresponds to the product casing outside diameter of the selected product casing. The selected product casing is installed over the internal casing and the adjustable support assembly is adjusted to maintain the coincidence of the internal casing longitudinal axis with the product casing longitudinal axis of the selected product casing. The selected cutter head is attached to the front end of the auger, and the pusher mechanism is operated to move the carriage from initial end 123 of track 28 to terminal end 124, thereby advancing the selected cutter head, the selected product casing, the auger and the internal casing in the desired boring direction, while the rotational mechanism is simultaneously operated to rotate the auger and the cutter blades. When the carriage reaches terminal end 124 of the track, the rotational mechanism and the pusher mechanism are stopped, and the selected product casing, the auger and the internal casing are disengaged from the carriage. The carriage is then retracted from the terminal end of the track to the initial end of the track, leaving the selected product casing, internal casing and auger in the bore. An additional adjustable support assembly is mounted to an additional section of internal casing, an additional section of auger is placed within the additional section of internal casing, and an additional section of the selected product casing is placed over the internal casing and auger, so that the additional adjustable support assembly maintains the coincidence of the internal casing longitudinal axis with the product casing longitudinal axis. The additional sections of product casing, internal casing and auger are placed on the track in front of the carriage, and the front ends of the additional section of the selected product casing, the additional section of the internal casing and the additional section of the auger are attached to the rear ends of the casing and conveyor sections that were disengaged from the carriage. The rear end of the additional section of the auger is attached to the rotational mechanism, and the rear ends of the additional section of the selected product casing, the additional section of the internal casing and the additional section of the auger are attached to or engaged by the pusher mechanism. The carriage is then moved by operation of the pusher mechanism to advance the selected cutter head, the selected product casing, the auger and the internal casing from the initial end of the track to the terminal end while operating the rotational mechanism to rotate the auger and the cutter head. These steps are then repeated until the selected product casing reaches the target pit.

When the product casing reaches the target pit, the cutter head is removed from the assembly and the steering head is detached from the first product casing section. The internal casing and auger sections may then be removed, leaving the product casings in the bore. In one method of operating the invention, the carriage is employed to pull the internal casing and auger sections backwardly to the launch pit, where they are removed, one by one. In another method of operation, an alternative driving mechanism is placed in the target pit and employed to pull the internal casing and auger sections forwardly out of the product casing into the target pit.

Although this description contains many specifics, these should not be construed as limiting the scope of the invention, but as merely providing illustrations of some of the presently preferred embodiments thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A boring machine for boring a tunnel from a launch pit to a target pit along a desired boring direction and simultaneously installing a selected one of a plurality of differently-sized product casings in the tunnel, in which each product casing of a selected size has a product casing longitudinal axis, a product casing outside diameter, a product casing inside diameter and a product casing inside surface, wherein the boring machine comprises:

(a) an internal casing:
- (i) having an internal casing front end;
- (ii) having an internal casing longitudinal axis;
- (iii) having an internal casing outside surface;
- (iv) having an internal casing outside diameter which is less than all of the product casing inside diameters of the differently-sized product casings that may be installed using the boring machine;
- (v) which is adapted to be placed within a selected one of the product casings with its internal casing longitudinal axis coincident with the longitudinal axis of the selected product casing, thereby forming an annular space with respect to the selected product casing;

(b) an adjustable support assembly that is adapted to be located between the outside surface of the internal casing and the inside surface of the selected product casing for maintaining the coincidence of the internal casing longitudinal axis with the product casing longitudinal axis without closing off the annular space between the internal casing and the selected product casing;

(c) an auger which:
- (i) has a front end;
- (ii) has a rear end;
- (iii) is located within the internal casing and adapted to rotate with respect thereto;
- (iv) is adapted to convey material towards its rear end as it is rotated;

(d) a rotational mechanism which is operationally connected to the auger;

(e) a pusher mechanism which is adapted to advance the selected product casing, the internal casing and the auger;

(f) a plurality of cutter heads, each of which:
- (i) includes a plurality of cutter blades that are adapted to be attached to the front end of the auger;
- (ii) has a cutter head diameter which corresponds to the product casing outside diameter of the selected product casing;

(g) a plurality of front bulkheads, each of which is adapted to be located between the inside surface of a selected one of the product casings and the outside surface of the internal casing behind a cutter head;

(h) a plurality of rear bulkheads, each of which:
- (i) is adapted to be located between the inside surface of a selected one of the product casings and the outside surface of the internal casing;
- (ii) is adapted to be located at the rear end of the auger;

(i) a rear hopper located behind the rear bulkhead;

(j) means for directing material cut by the cutter head into the internal casing so that rotation of the auger will convey such material rearwardly within the internal casing to the rear hopper;

(k) a transverse conveyor which is:
- (i) located behind the rear bulkhead in the rear hopper;
- (ii) adapted to convey material out of the rear hopper in a direction transverse to the auger longitudinal axis.

2. The boring machine of claim 1 wherein:

(a) each cutter blade has a front side and a rear side;

(b) the means for directing material cut by the selected cutter head into the internal casing comprises a plurality of collecting buckets, each of which is mounted on the rear side of a cutter blade, which collecting buckets sweep material cut by the cutter blades into the internal casing as the cutter blades rotate.

3. The boring machine of claim 1 wherein the adjustable support assembly comprises a plurality of internal casing support legs spaced around the periphery of the internal casing.

4. The boring machine of claim 3 which includes an internal support band:

(a) that is disposed around the periphery of the internal casing;

(b) to which the internal casing support legs are attached.

5. The boring machine of claim 4 wherein the internal support band includes a plurality of leg supports, each of which is adapted to cooperate with an internal casing support leg.

6. The boring machine of claim 5 wherein each internal casing support leg is provided with external threads and each leg support is provided with corresponding internal threads.

7. The boring machine of claim 1 wherein the internal casing comprises a plurality of internal casing components that are joined together end to end at a plurality of internal casing joints, wherein each such internal casing joint comprises:

(a) an end flange mounted to adjacent ends of adjacent internal casing components;

(b) a clamp that is adapted to engage the end flanges of adjacent internal casing components.

8. The boring machine of claim 7 wherein each clamp is adapted to encircle and engage the end flanges of adjacent internal casing components.

9. The boring machine of claim 7 wherein each end flange comprises:

(a) a band portion that is secured to the outside surface of the internal casing;

(b) an upstanding rim that is adapted to be engaged by the clamp.

10. The boring machine of claim 9 wherein each clamp comprises:

(a) a band comprising:
- (i) a pair of flange engagement sides;
- (ii) a first end having a pair of spaced eyes, each of which includes a hole;
- (iii) a second end having an engagement bracket which includes an engagement slot;

(b) a bolt comprising:
(i) a T-shaped head that is adapted to be received in the holes in the spaced eyes at the first end of the band;
(ii) a threaded end that extends into the engagement slot of the engagement bracket;
(c) a nut that is adapted to engage the threaded end of the bolt and be retained within the engagement bracket.

11. A boring machine comprising:
(a) a track;
(b) a carriage that is mounted on the track, said carriage comprising:
(i) a carriage front end having a carriage bulkhead;
(ii) a pusher mechanism that is adapted to move the carriage along the track;
(iii) a rotational mechanism;
(c) an internal casing that is located in front of the carriage and adapted to be moved by the carriage as the pusher mechanism moves the carriage along the track;
(d) an auger which:
(i) has a front end;
(ii) has a rear end;
(iii) has a longitudinal axis and flighting;
(iv) is located within the internal casing;
(v) is adapted to rotate with respect to the internal casing;
(vi) is operationally connected to the rotational mechanism of the carriage;
(v) is adapted to convey material towards its rear end as it is rotated;
(e) a cutter head that includes a plurality of cutter blades which are attached to the front end of the auger so as to rotate therewith;
(f) a rear bulkhead that is located at the rear end of the auger behind the auger flighting in front of the carriage bulkhead so as to define a rear hopper between the rear bulkhead and the carriage bulkhead;
(g) means for directing material cut by the cutter head into the auger so that rotation of the auger will convey such material rearwardly to the rear hopper;
(h) a transverse conveyor located behind the rear bulkhead in the rear hopper which is adapted to convey material out of the rear hopper in a direction transverse to the longitudinal axis of the auger.

12. The boring machine of claim 11 wherein:
(a) each cutter blade has a front side and a rear side;
(b) the means for directing material cut by the cutter head into the auger comprises a plurality of collecting buckets, each of which is mounted on the rear side of a cutter blade, which collecting buckets sweep material cut by the cutter blades into the auger as the cutter head rotates.

13. The boring machine of claim 12:
(a) which includes a front bulkhead located around the internal casing and spaced from the cutter blades so as to define a front hopper within the cutter head;
(b) wherein the collecting buckets direct material cut by the cutter blades into the auger within the front hopper so that rotation of the auger will convey such material rearwardly to the rear hopper.

14. A method for boring a tunnel from a launch pit to a target pit along a desired boring direction and simultaneously installing a selected one of a plurality of differently-sized product casings in the tunnel, in which each product casing of a selected size has a product casing longitudinal axis, a product casing outside diameter, a product casing inside diameter and a product casing inside surface, wherein the method comprises:
(a) providing a boring machine comprising:
(i) an internal casing:
(1) having an internal casing longitudinal axis;
(2) having an internal casing outside surface;
(3) having an internal casing outside diameter which is less than all of the product casing inside diameters of the differently-sized product casings that may be installed using the boring machine;
(4) which is adapted to be placed within a selected one of the product casings with its internal casing longitudinal axis coincident with the longitudinal axis of the selected product casing, thereby forming an annular space with respect to the selected product casing;
(ii) an adjustable support assembly that is adapted to be located between the outside surface of the internal casing and the inside surface of the selected product casing for maintaining the coincidence of the internal casing longitudinal axis with the product casing longitudinal axis without closing off the annular space between the internal casing and the selected product casing;
(iii) an auger which:
(1) has a front end;
(2) has a rear end;
(3) is located within the internal casing and adapted to rotate with respect thereto;
(4) is adapted to convey material towards its rear end as it is rotated;
(iv) a track having:
(1) an initial end;
(2) a terminal end;
(v) a carriage that is adapted to be mounted on the track and moved therealong, which carriage includes:
(1) a rotational mechanism which is operationally connected to the auger;
(2) a pusher mechanism which is adapted to move the carriage along the track to advance the selected product casing, the internal casing and the auger;
(vi) a plurality of cutter heads, each of which:
(1) has a plurality of cutter blades which are adapted to be attached to the front end of the auger;
(2) has a cutter head diameter which corresponds to the product casing outside diameter of one of the differently-sized product casings;
(vii) which includes means for directing material cut by the cutter blades into the internal casing so that rotation of the auger will convey such material towards the rear end of the auger within the internal casing;
(viii) a plurality of rear bulkheads, each of which:
(1) is adapted to be located between the inside surface of a selected one of the product casings and the outside surface of the internal casing;
(2) is adapted to be located at the rear end of the auger;
(ix) a rear hopper located behind the rear bulkhead;
(x) means for directing material cut by the cutter head into the internal casing so that rotation of the auger will convey such material rearwardly within the internal casing to the rear hopper;
(xi) a transverse conveyor which is:
(1) located behind the rear bulkhead in the rear hopper;
(2) adapted to convey material out of the rear hopper in a direction transverse to the auger longitudinal axis;
(b) excavating a launch pit;
(c) excavating a target pit;
(d) placing the track in the launch pit and orienting it in the desired boring direction towards the target pit;

(e) mounting the carriage on the track in the launch pit;

(f) selecting a product casing from the differently-sized product casings that may be installed using the boring machine;

(g) selecting a cutter head having a cutter head diameter which corresponds to the product casing outside diameter of the selected product casing;

(h) installing the selected product casing over the internal casing;

(i) adjusting the adjustable support assembly to maintain the coincidence of the internal casing longitudinal axis with the product casing longitudinal axis of the selected product casing;

(j) attaching the selected cutter head to the front end of the auger;

(k) operating the rotational mechanism to rotate the auger and the cutter blades while operating the pusher mechanism to advance the selected cutter head, the selected product casing, the auger and the internal casing.

15. The method of claim 14 which includes:

(a) operating the pusher mechanism to move the carriage from the initial end of the track to the terminal end of the track, thereby advancing the selected cutter head, the selected product casing, the auger and the internal casing in the desired boring direction, while operating the rotational mechanism to rotate the auger and the cutter blades;

(b) stopping the operation of the rotational mechanism and the pusher mechanism;

(c) disengaging the selected product casing, the auger and the internal casing from the carriage;

(d) retracting the carriage from the terminal end of the track to the initial end of the track;

(e) providing an additional section of internal casing having a front end and a rear end;

(f) mounting an additional adjustable support assembly to the additional section of internal casing;

(g) providing an additional section of auger having a front end and a rear end;

(h) placing the additional section of auger within the additional section of internal casing with the front end of the additional section of auger adjacent to the front end of the additional section of internal casing;

(i) providing an additional section of the selected product casing having a front end and a rear end;

(j) placing the additional section of the selected product casing over the internal casing and auger with the front end of the additional section of the selected product casing adjacent to the front ends of the internal casing and auger, so that the additional adjustable support assembly maintains the coincidence of the internal casing longitudinal axis with the product casing longitudinal axis;

(k) placing the additional sections of product casing, internal casing and auger onto the track in front of the carriage;

(l) attaching the front ends of the additional section of the selected product casing, the additional section of the internal casing and the additional section of the auger to the casing and conveyor sections that were disengaged from the carriage;

(m) attaching the rear end of the additional section of the auger to the rotational mechanism;

(n) engaging the rear ends of the additional section of the selected product casing, the additional section of the internal casing and the additional section of the auger with the pusher mechanism;

(o) moving the carriage from the initial end of the track to the terminal end of the track while operating the rotational mechanism to rotate the auger and the cutter head, and while operating the pusher mechanism to advance the selected cutter head, the selected product casing, the auger and the internal casing;

(p) repeating steps (b) through (o) until the selected product casing reaches the target pit.

* * * * *